US010760298B2

(12) United States Patent
Crandall et al.

(10) Patent No.: US 10,760,298 B2
(45) Date of Patent: Sep. 1, 2020

(54) FENCE BRACE SYSTEM ADAPTED FOR USE WITH CYLINDRICAL FENCE POSTS

(71) Applicants: Fonda Crandall, Reno, NV (US); Joseph Crandall, Reno, NV (US)

(72) Inventors: Fonda Crandall, Reno, NV (US); Joseph Crandall, Reno, NV (US)

( * ) Notice: Subject to any disclaimer, the term of this patent is extended or adjusted under 35 U.S.C. 154(b) by 0 days.

(21) Appl. No.: 16/517,580

(22) Filed: Jul. 20, 2019

(65) Prior Publication Data

US 2019/0338554 A1 Nov. 7, 2019

Related U.S. Application Data

(63) Continuation-in-part of application No. 14/863,793, filed on Sep. 24, 2015, now Pat. No. 10,060,408, which is a continuation-in-part of application No. 15/856,635, filed on Dec. 28, 2017.

(51) Int. Cl.
*E04H 17/14* (2006.01)
*E04H 17/20* (2006.01)

(52) U.S. Cl.
CPC ..... *E04H 17/1421* (2013.01); *E04H 17/1434* (2013.01); *E04H 17/1443* (2013.01); *E04H 17/20* (2013.01); *E04H 2017/146* (2013.01); *E04H 2017/1473* (2013.01); *E04H 2017/1482* (2013.01)

(58) Field of Classification Search
CPC ..... E04H 17/143; E04H 17/1434; E04H 17/1413; E04H 17/1417; E04H 17/1421; E04H 17/1426; E04H 2017/1452; E04H 2017/1447; E04H 2017/1473
See application file for complete search history.

(56) References Cited

U.S. PATENT DOCUMENTS 949,394 A * 2/1910 Daly ..... E04B 1/2403 403/173
4,526,348 A * 7/1985 Cammack ..... E04H 17/1413 256/65.06
5,297,890 A * 3/1994 Commins ..... F16B 2/065 248/74.1
5,657,967 A * 8/1997 Patrick ..... B29B 17/0042 256/19
6,290,214 B1 * 9/2001 DeSouza ..... E04H 17/1413 256/55
6,802,496 B1 * 10/2004 Preta ..... E04H 17/1413 16/253
2014/0264220 A1 * 9/2014 Doyle ..... E04H 17/1421 256/65.06

FOREIGN PATENT DOCUMENTS

GB 325612 A * 2/1930 ..... E04H 17/1413
GB 677092 A * 8/1952 ..... E04H 17/1413

* cited by examiner

*Primary Examiner* — Michael P Ferguson

(57) ABSTRACT

The present invention comprises a brace adapted to secure one or more fence rails to a fence post. The present invention brace may optionally be installed onto an existing fence or on a new fence. The invention includes a first fence rail brace member adapted to connect to two or more sides of a first fence rail, a second fence rail brace member adapted to connect to two or more sides of a second fence rail, and a fence post member adapted to connect to two or more sides of a fence post. The fence post brace member may form a picket fastener slot for use in affixing a picket to the fence post. The fence post brace system may be adapted for use with cylindrical fence posts or rectangular fence posts.

4 Claims, 11 Drawing Sheets

FENCE BRACE SYSTEM ADAPTED FOR USE WITH CYLINDRICAL FENCE POSTS

CROSS-REFERENCES TO RELATED APPLICATIONS

This non-provisional utility application is a continuation-in-part (CIP) application of the pending U.S. application Ser. No. 14/863,793 titled "Fence Brace System" and originally filed Sep. 24, 2015, and of the pending U.S. application Ser. No. 15/856,635 titled "Fence Brace System" and originally filed Dec. 28, 2017 (pending U.S. application Ser. No. 15/856,635 is a divisional application of pending U.S. application Ser. No. 14/863,793), which are hereby incorporated in their entirety by reference.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BRIEF DESCRIPTION OF THE INVENTION

The present invention relates to the field of fences. More particularly, the present invention relates to a system for providing structural support for fences including for fences having one or more cylindrical fence posts.

The present invention provides strength for building a new fence or repairing an existing fence. The fence would not need to be removed or modified to install the herein disclosed brace. Installation would be simple. The brace could be mass produced at low cost. The color and style of the brace could be easily adapted to match aesthetically with the fence and the surrounding area. The brace itself may be painted, stained, powder coated, colored, or made with a colored metal. The brace may also be built into a new fence. The present invention optionally includes embodiments adapted for fences with rectanguloid rails or for rectanguloid fence posts. The present invention may be optionally optimized for a fence with cylindrical fence posts. The present invention may also include an embodiment adapted to secure the corner pieces of the fence. In an additional optional embodiment, the present invention is adapted to secure a fence on a slope. The brace may be made of strong weather-resistant material such as steel, stainless steel, galvanized steel, aluminum, plastic, graphite, wood, or any composite material(s).

BACKGROUND OF THE INVENTION

Fence and fence structure are subject to damage due to high winds, torrential rains, heavy snowfall, vehicular accidents, termites, vandalism, earthquakes and falling trees and branches. The most common of these causes is high winds. Wind damages fences all around the world every year. Fences made of wood are especially susceptible to wind damage because wood is weakened by prolonged exposure to rain, snow, wind, and other elements. Despite the potential for damage, wood is still by far the most common residential fencing material in the United States. In 2007 alone, Americans put up 59,000 miles of wood fencing, enough to circle the globe twice. Wood is inexpensive and lightweight, and a wood fence can easily be shaped to give properties character and individuality. There are many styles, including linear post-and-rail and crisscrossing lattice, as well as myriad picket patterns and post-cap designs. And the wood may be painted or stained to match almost any landscape.

Fences could be built much stronger through the use of heavy materials such as steel and sturdy construction. However, this might drive the costs of the fence up above what is acceptable. As well, there are the aesthetic considerations discussed above. Also, it is unlikely that a property owner would replace an existing fence merely because of the possibility that it could be damaged by the elements.

There is an unmet need, therefore, for an inexpensive way to provide a fence with additional structural support. The need is especially great with respect to existing fences and with respect to wooden fences.

DETAILED DESCRIPTION OF THE INVENTION

Figure 2:
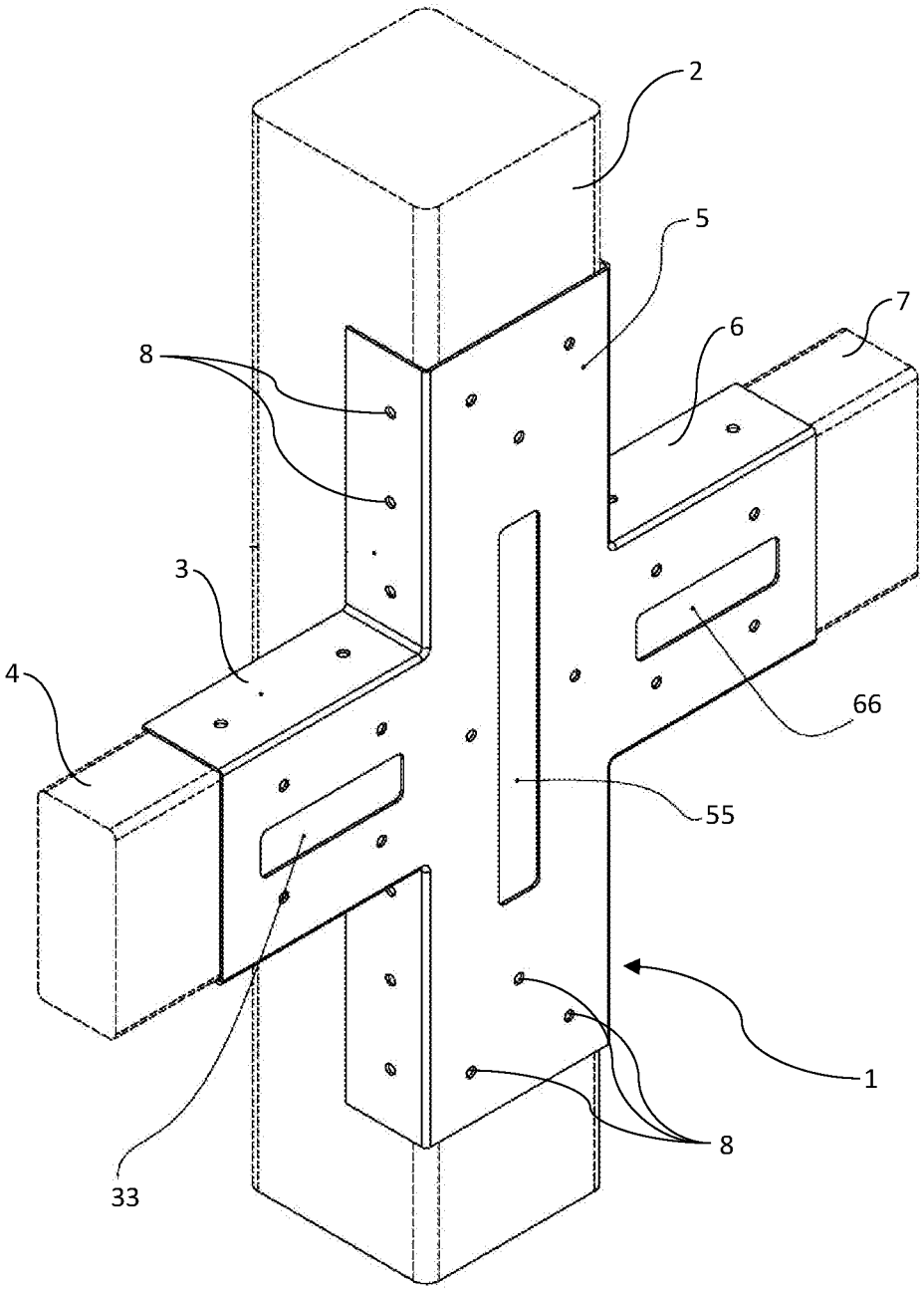
FIG. 2 illustrates an isometric view of a preferred embodiment of a fence brace, in accordance with the present invention.

In a preferred embodiment as illustrated in FIG. 2, the present invention comprises fence brace 1 for securing at least one fence rail 4 to fence post 2 including first fence rail brace member 3 adapted to connect to two or more sides of first fence rail 4. First fence rail brace member 3 may be fused to a first side of fence post brace member 5 wherein fence post brace member 5 is adapted to connect to two or more sides of fence post 2. The fence rail may be rectanguloid. As used herein, the term "rectanguloid" means a solid (3-dimensional) object which has six faces that are rectangles. It has the same cross-section along a length. As used herein, "rectanguloid" is the same as a rectangular prism. A rectanguloid may be though of as a 3-dimensional version of a rectangle or a square. The herein disclosed fence brace system may further include second fence rail brace member 6 fused to a second side of fence post brace member 5, wherein second fence rail brace member 6 is adapted to connect to two or more sides of second fence rail 7.

Fence brace 1 may include plurality of holes 8 thereby allowing fence post brace member 5 to be securely fastened to fence post 2 and thereby allowing first fence rail brace member 3 to be securely fastened to first fence rail 4 and second fence rail brace member 7 to be securely fastened to second fence rail 7. The plurality of holes may be referred to as screw-holes, nail holes, bolt holes, or other fastener holes. The plurality of holes may each receive a screw, a nail, a bolt, or an alternative type of fastener for securely connecting fence brace 1 to the fence post and/or the fence rail(s). The various figures illustrate the plurality of holes positioned in exemplary locations; those skilled in the art will recognize that the plurality of holes may be formed in various locations on the fence brace to provide the intended benefit of allowing secure attachment of the fence brace to the fence (the fence post and the fence rails).

Fence brace 1 may be formed of a strong weather-resistant material such as selected from the group consisting of steel, stainless steel, galvanized steel, aluminum, plastic, graphite, wood, or any composite material(s).

An embodiment of the present invention may further include one or more picket fastener slots for allowing one or more pickets (or boards) to be attached to the fence. For example, and as illustrated in FIG. 2 as a preferred embodiment, fence post brace member 5 forms vertical picket fastener slot 55, first fence rail brace member 3 forms first horizontal picket fastener slot 33, and second fence rail brace member 6 forms second horizontal picket fastener slot 66. This embodiment allows for attachment of a picket to fence post 2 through vertical picket fastener slot 55, attachment of a picket to first fence rail 4 through first horizontal picket fastener slot 33, and/or attachment of a picket to second fence rail 7 through second horizontal picket fastener slot 66. After fastening one or more pickets through the respective picket fastener slot, the herein disclosed fence brace is positioned in between the fence and the picket.

Figure 3:
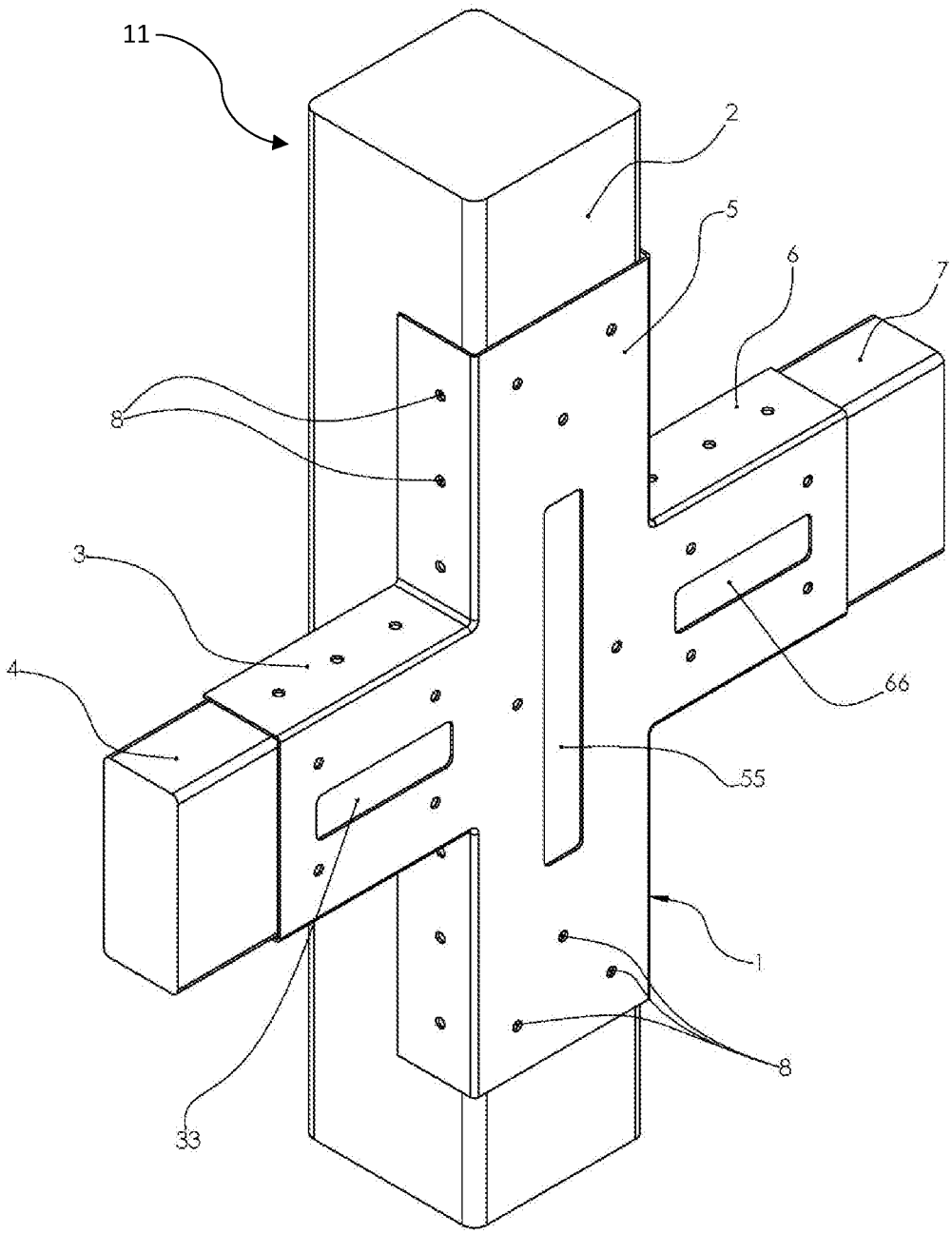
FIG. 3 illustrates an isometric view of a preferred embodiment of a fence assembly including a fence brace, a fence post, and a plurality of linearly disposed fence rails in accordance with the present invention.

Referring to FIG. 3, an embodiment of a fence brace assembly is illustrating comprising fence brace 1 attached to fence 11. Fence brace 1 includes fence post brace member 5 attached to fence post 2 and forming vertical picket fastener slot 55, first fence rail brace member 3 attached to first fence rail 4 and forming first horizontal picket fastener slot 33, and second fence brace member 6 attached to second fence rail 7 and forming second horizontal picket fastener slot 66.

Throughout this specification the fence brace system is mostly described as including a fence post brace member, a first fence rail brace member, and a second fence rail brace member. But for the present invention, fence post brace member 5 may alternatively be referred to as a pair of opposing upper and lower fence post flanges, each of the fence post flanges comprising a planer central wall and a pair of rearward-protruding side walls extending along opposing vertical longitudinally-extending edges of the central wall, the sidewalls of the upper fence post flange being vertically-aligned with the sidewalls of the lower fence post flange to define a pair of aligned channels for receiving the fence post therein. First fence rail brace member 3 and second fence rail brace member 6 may alternatively be referred to as a pair of opposing left and right fence rail flanges, each of the fence rail flanges comprising a planar central wall and a pair of rearward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein.

Figure 1:
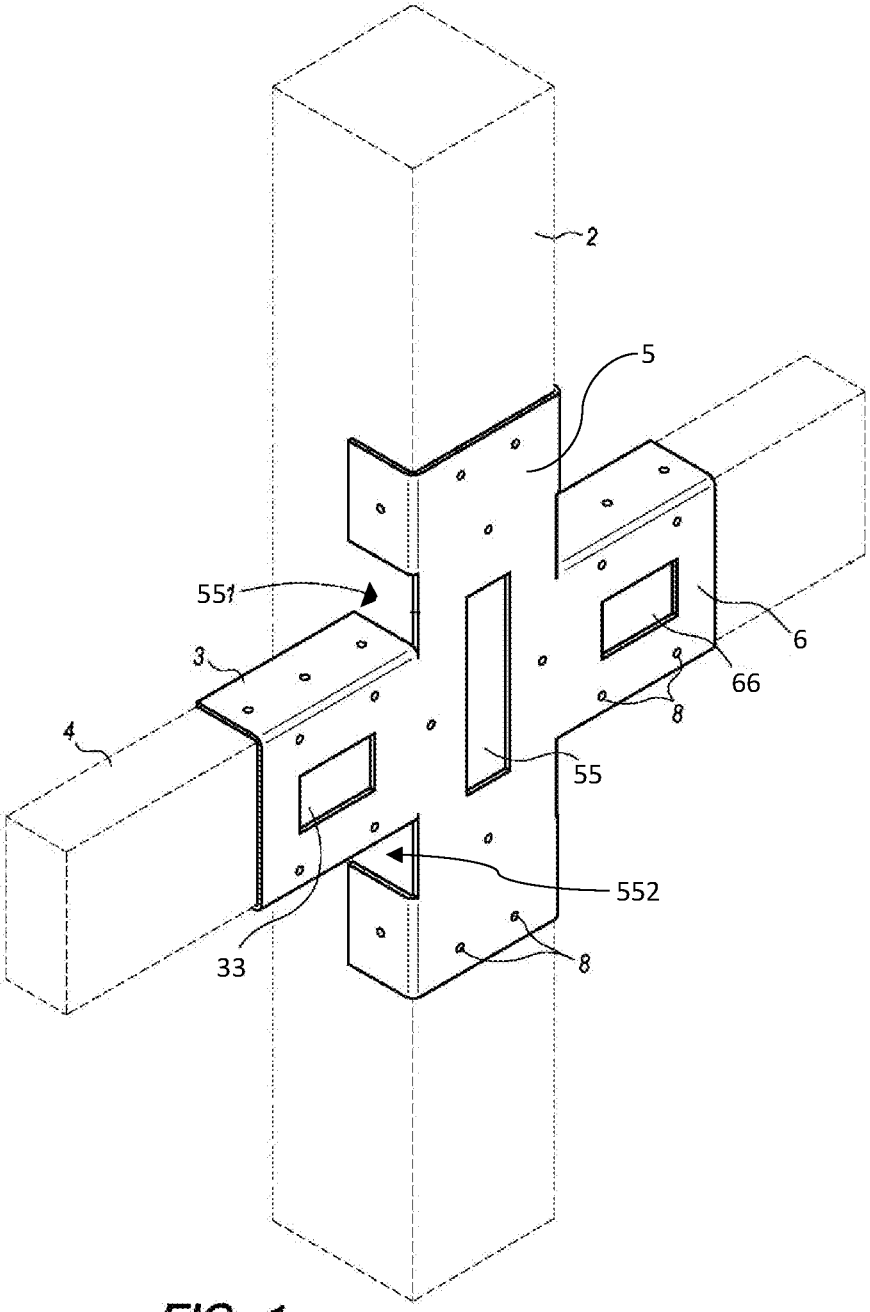
FIG. 1 illustrates an isometric view of an embodiment of a fence brace, wherein one or more cutouts are formed by the fence brace, in accordance with the present invention.

Referring to FIG. 1, an alternative embodiment of the herein disclosed fence brace system is illustrated wherein the rearward-protruding side walls of the opposing upper and lower fence post flanges do not extend all the way to the first and second fence rails. In this embodiment illustrated in FIG. 1, an upper flange cutout 551 is formed on each side of the upper flange and a lower flange cutout 552 is formed on each side of the lower flange. The embodiment illustrated in FIG. 2 differs in that the pair of rearward-protruding side walls extend fully towards first fence rail brace member and the second fence rail brace member so that the entire edge of the fence post (or a larger portion of the edge of the fence post) is covered by the rearward-protruding side walls.

Figure 4:
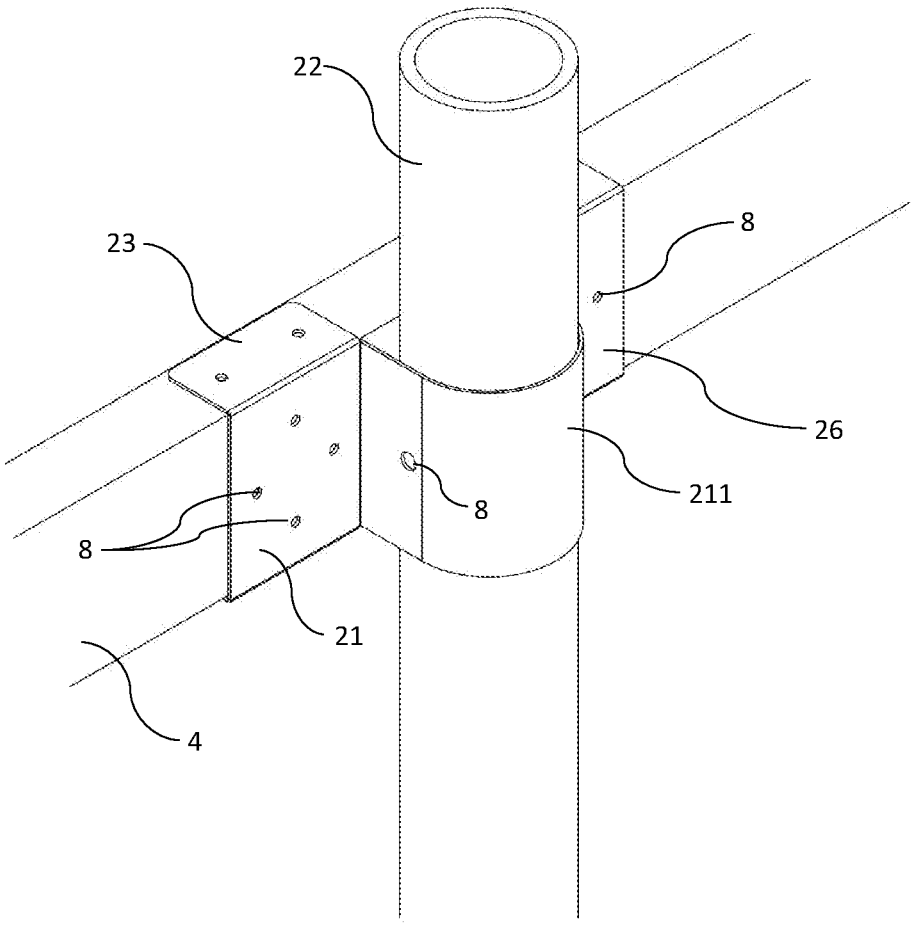
FIG. 4 illustrates an isometric view of an alternative embodiment of a fence assembly adapted for use with a cylindrical fence post including a fence brace, a cylindrical fence post, and a fence rail positioned next to the cylindrical fence post so that the fence rail may extend continuously past the cylindrical fence post, in accordance with the present invention.
Figure 5:
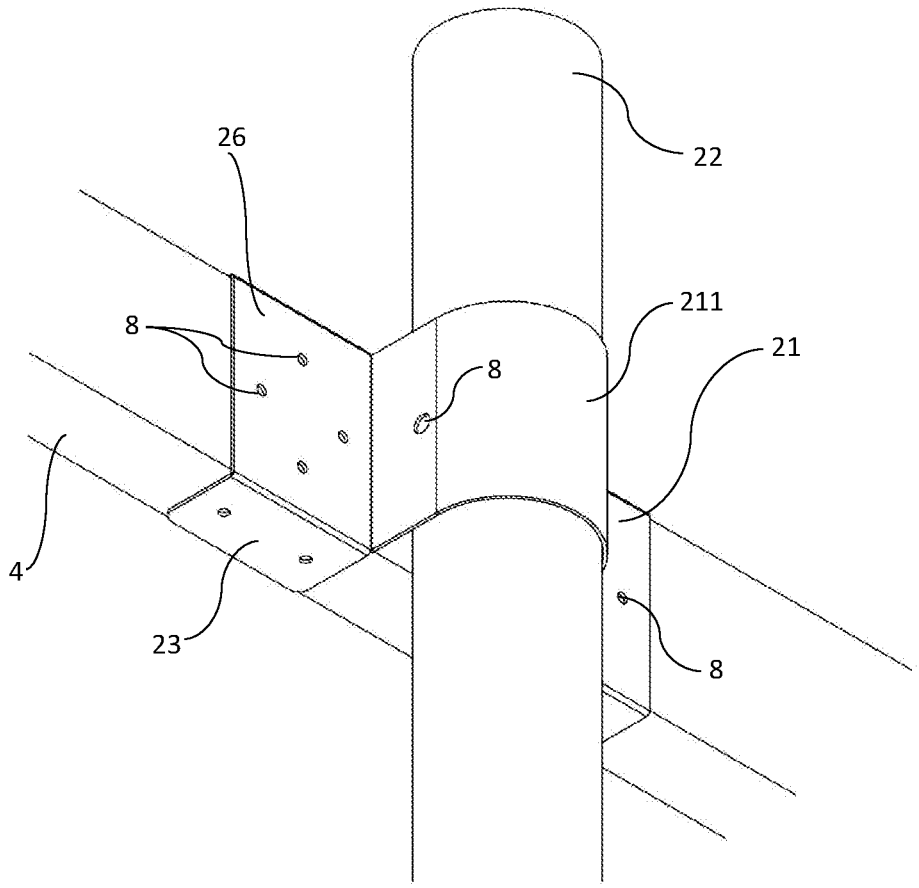
FIG. 5 illustrates a reverse isometric view of the alternative embodiment depicted in FIG. 4 of a fence assembly adapted for use with a cylindrical fence post, including a fence brace, a cylindrical fence post, and a fence rail positioned next to the cylindrical fence post so that the fence rail may extend continuously past the cylindrical fence post, in accordance with the present invention.
Figure 6:
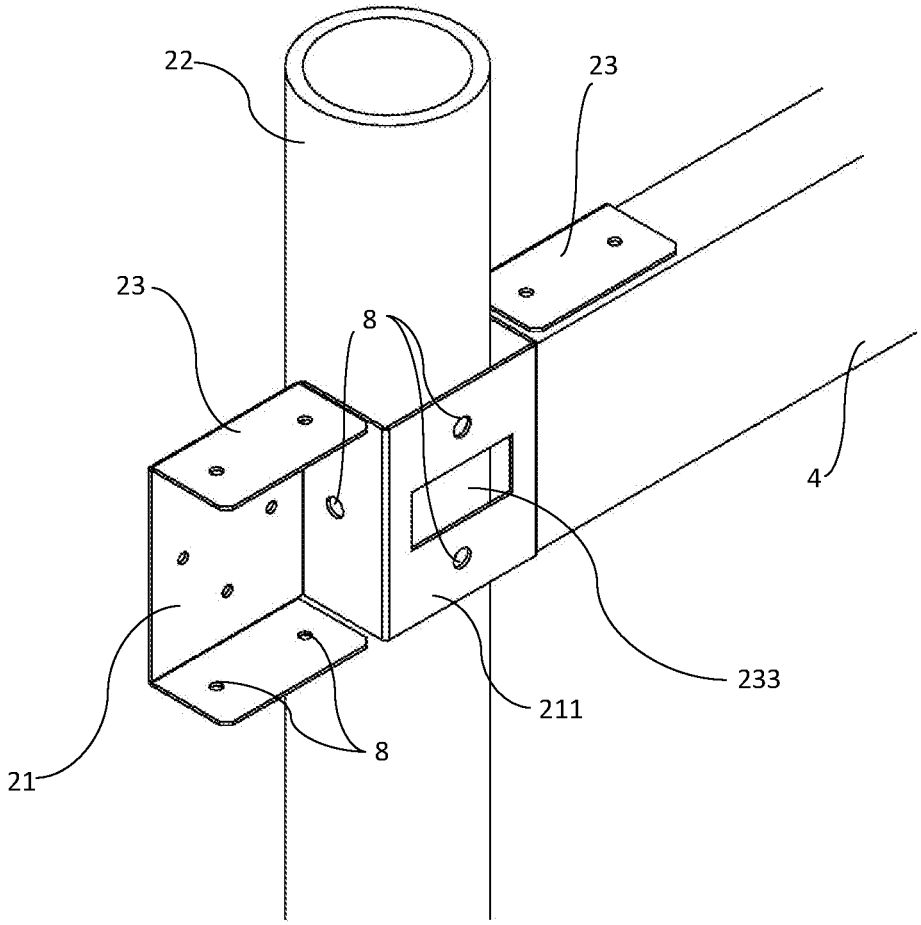
FIG. 6 illustrates an isometric view of a differing alternative embodiment of a fence assembly adapted for use with a cylindrical fence post, wherein the arc-shaped fence post brace member is adapted to form two right angles as it spans the cylindrical fence post, including a fence brace, a cylindrical fence post, and a linearly disposed fence rail in accordance with the present invention.
Figure 7:
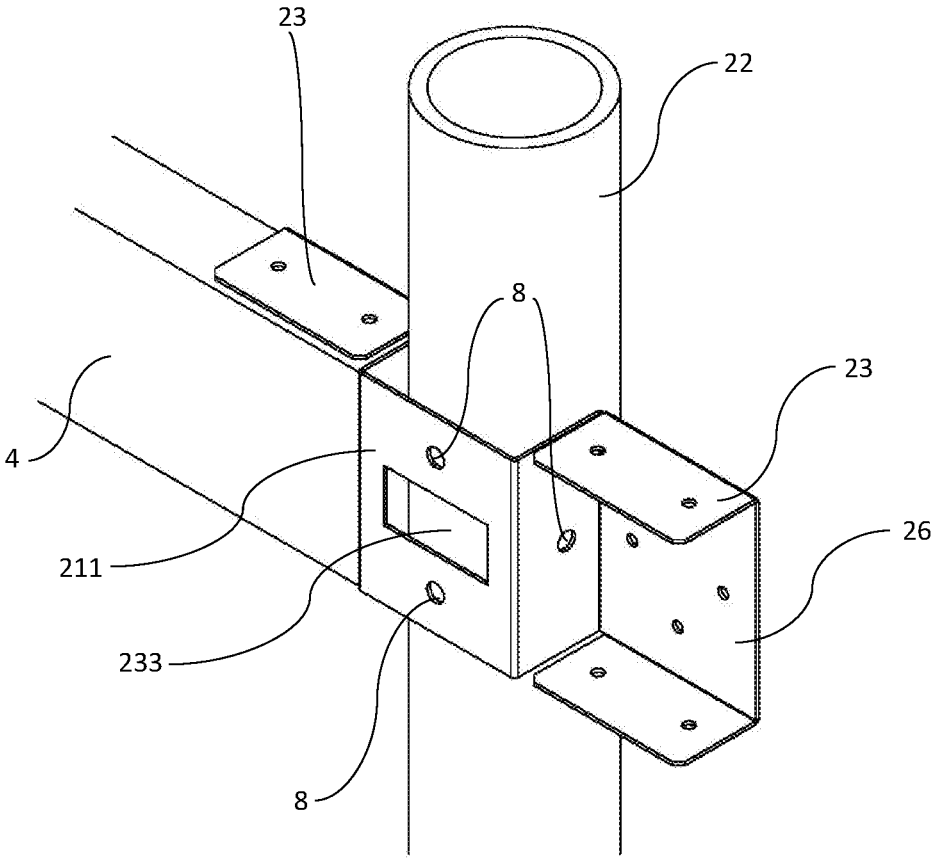
FIG. 7 illustrates a reverse isometric view of the alternative embodiment depicted in FIG. 6 of a fence assembly adapted for use with a cylindrical fence post, wherein the arc-shaped fence post brace member is adapted to form two right angles as it spans the cylindrical fence post, including a fence brace, a cylindrical fence post, and a linearly disposed fence rail in accordance with the present invention.
Figure 8:
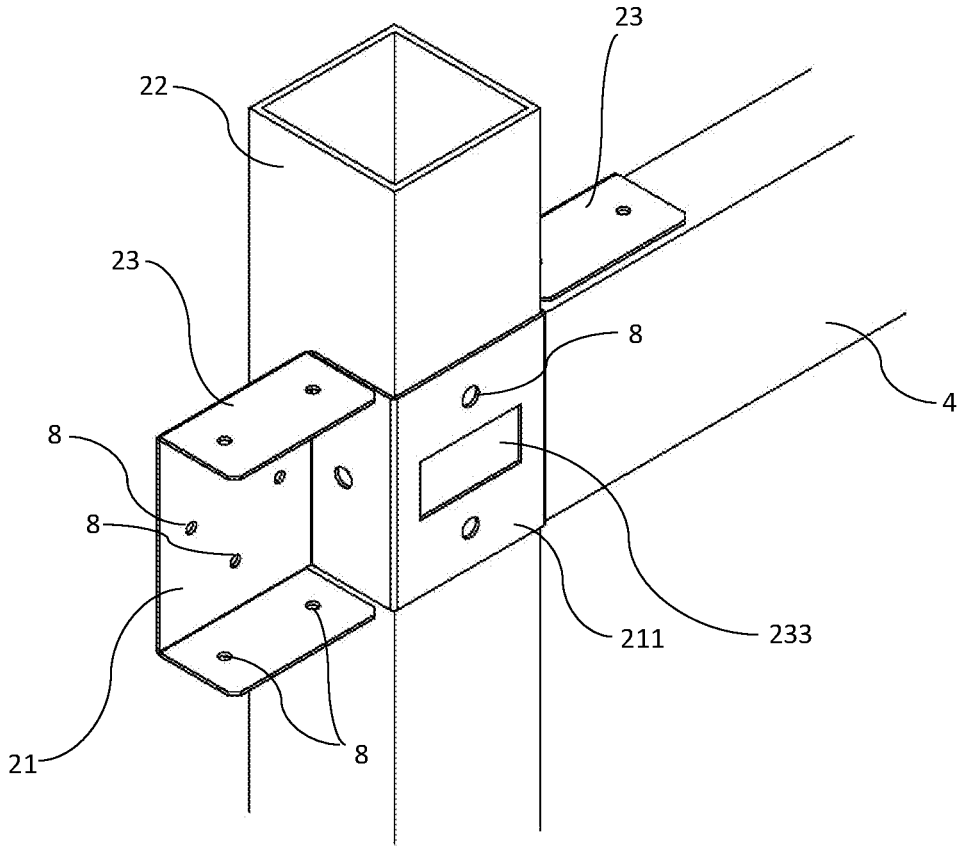
FIG. 8 illustrates an isometric view of the alternative embodiment depicted in FIG. 6 of the fence assembly in use with a rectanguloid fence post, wherein the arc-shaped fence post brace member is adapted to form two right angles as it spans the fence post, including a fence brace, a rectanguloid fence post, and a linearly disposed fence rail in accordance with the present invention.
Figure 9:
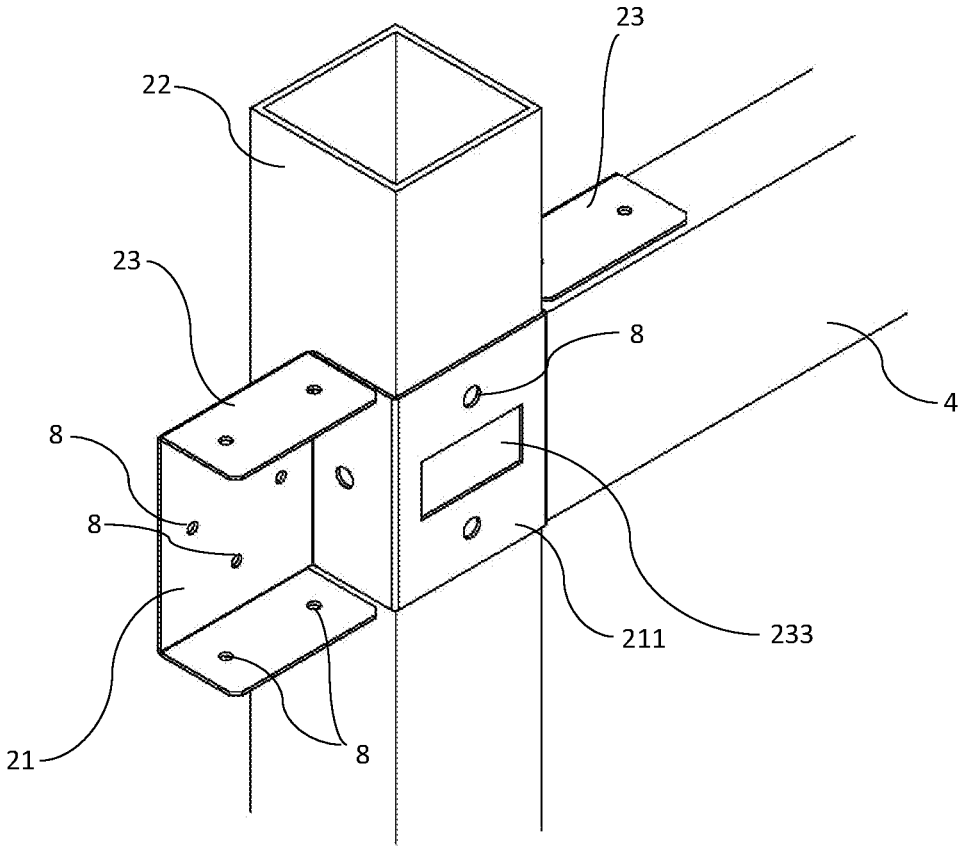
FIG. 9 illustrates an isometric view of the alternative embodiment depicted in FIG. 6 of the fence assembly in use with a rectanguloid fence post, wherein the arc-shaped fence post brace member is adapted to form two right angles as it spans the fence post, including a fence brace, a rectanguloid fence post, and a linearly disposed fence rail in accordance with the present invention.
Figure 10:
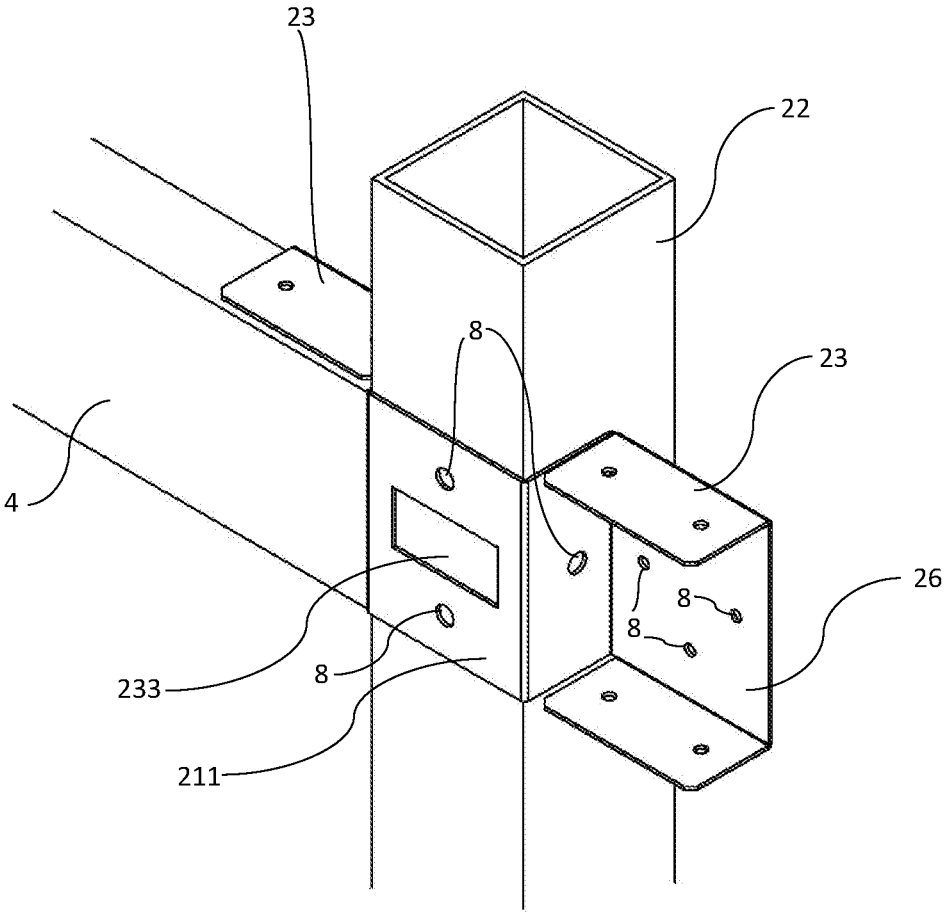
FIG. 10 illustrates a reverse isometric view of the alternative embodiment depicted in FIG. 6 of the fence assembly in use with a rectanguloid fence post, wherein the arc-shaped fence post brace member is adapted to form two right angles as it spans the fence post, including a fence brace, a rectanguloid fence post, and a linearly disposed fence rail in accordance with the present invention.
Figure 11:
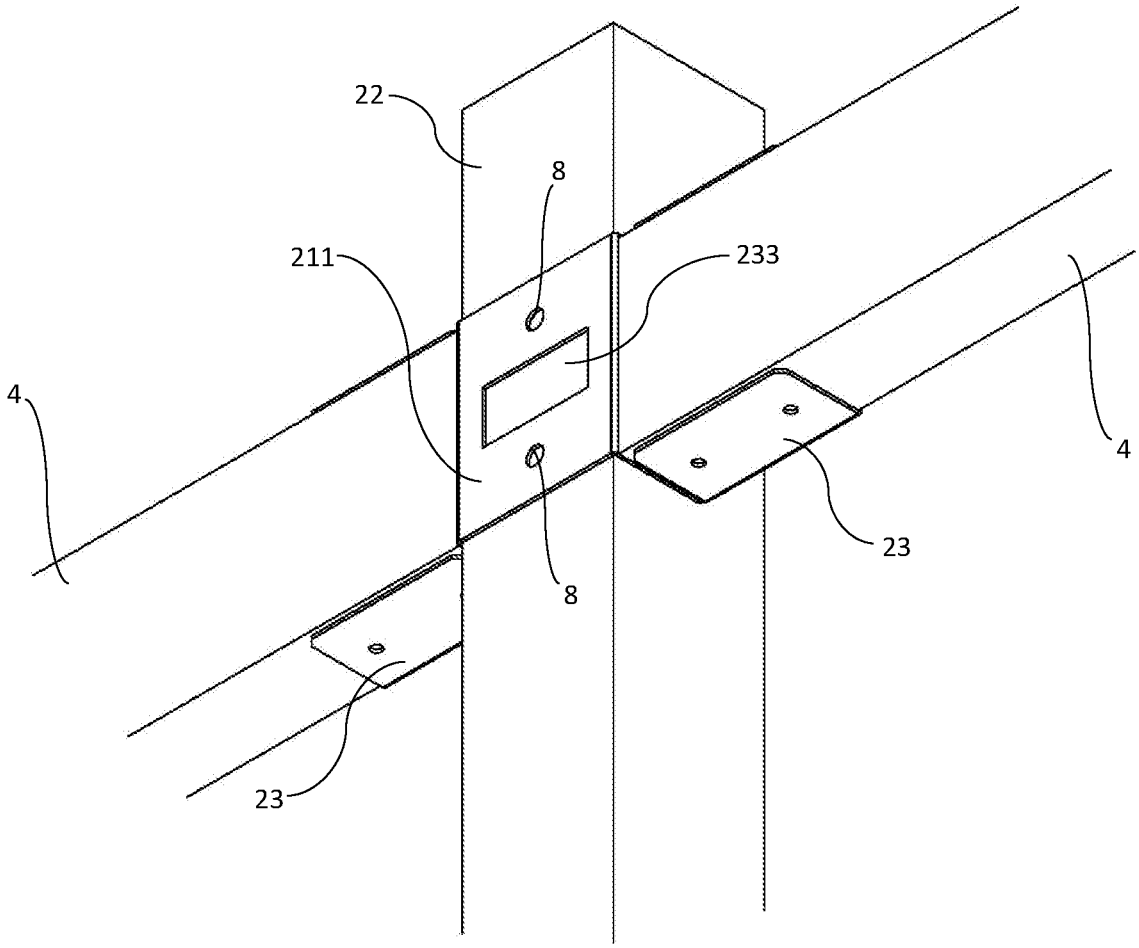
FIG. 11 illustrates a reverse isometric view of the alternative embodiment depicted in FIG. 6 of the fence assembly in use with a rectanguloid fence post, wherein the arc-shaped fence post brace member is adapted to form two right angles as it spans the fence post, including a fence brace, a rectanguloid fence post, and a plurality of linearly disposed fence rails in accordance with the present invention.

Referring to FIG. 4, an alternative embodiment of the fence assembly adapted for use with a cylindrical fence post is shown. In this alternative embodiment, the fence brace assembly includes cylindrical fence post 22 attached to rectangular fence rail 4 in a manner that allows fence rail 4 to extend continuously past the cylindrical fence post. In this alternative embodiment, the fence brace includes a first (or left) rail flange 21 and a second (or right) rail flange 26, wherein each rail flange forms a plurality of fastener holes 8, which may be referred to as screw-holes, nail holes, bolt holes or other fastener holes. Both first rail flange 21 and second rail flange 26 additionally form rearward-protruding walls 23 that extend over fence rail 4 so that rail flanges 21 and 26 may be secured to the fence rail via one or more fasteners pasted through fastener holes 8. This alternative embodiment further includes arc-shaped fence post brace member 211 adapted to partially surround the cylindrical fence post as the arc-shaped fence post brace member 211 spans from first rail flange 21 to second rail flange 26. Arc-shaped fence post brace member 211 may be formed in a curved shape to allow arc-shaped fence post brace member 211 to be placed flush or nearly flush with the rounded surface of cylindrical fence post 22. FIG. 5 depicts a reverse angle view of the alternative embodiment from FIG. 4 to demonstrate that first rail flange 21 is a formed similarly to second rail flange 26 (in other words, the flanges are mirror images of each other).

Referring to FIG. 6 through FIG. 11, a differing alternative embodiment is shown that utilizes a central portion of the fence brace forming two right angles as it spans from first rail flange 21 to second rail flange 26. The term right angle is used to describe angles that are approximately 90 degrees and form a shape that can partially wrap around at least three sides of a rectangular fence post. In this alternative embodiment, the arc-shaped fence post brace member may not be arc-shaped at all and may instead include three planes arranged at two right angles to form a bracket-like member that may cover (partially or completely) three sides of a rectangular or rectanguloid fence post 22 or may surround approximately half of a cylindrical fence post 22. FIG. 7 through 11 depict this differing alternative embodiment from various viewing angles and in use with differing fence posts such as cylindrical fence post 22 in FIG. 6 and FIG. 7 and a rectangular or rectanguloid fence post 22 in FIG. 8 through FIG. 11.

In the alternative embodiment shown in FIG. 6 through FIG. 11, central portion 211 is disposed between first rail flange 21 and second rail flange 26 and forms horizontal picket fastener slot 233 in addition to one or more fastener holes 8. When a user wishes to attach or affix a picket to fence post 22, the user may pass a fastener through a picket and then through picket fastener slot 233 and into fence post 22. In this alternative embodiment, first rail flange 21 and second rail flange 26 both form forward-protruding walls 23 extending along opposing horizontal longitudinally-extending edges of the central portion 211 of the fence brace member wherein the forward-protruding walls of first rail flange 21 are horizontally-aligned with the forward-protruding walls of second rail flange 26 to define a pair of aligned channels for receiving the fence rails 4 therein.

Referring to FIG. 8 through FIG. 11, the herein disclosed alternative embodiment of the fence brace is shown in use with a rectangular or rectanguloid fence post 22. The fence brace system can be utilized advantageously with a rectangular fence post in a similar manner as with a cylindrical fence post to form a fence brace assembly including fence post 22 having a rectangular cross-section, at least one fence rail 4 having a rectangular cross-section, and a fence brace as illustrated in FIG. 8 through FIG. 11 and described herein.

While the present invention has been illustrated and described herein in terms of a preferred embodiment and several alternatives, it is to be understood that the devices, systems, and assemblies described herein can have a multitude of additional uses and applications. Accordingly, the invention should not be limited to just the particular description and various drawing figures contained in this specification that merely illustrate a preferred embodiment and application of the principles of the invention.

What is claimed is:

1. A fence assembly comprising;

a fence post having a circular or rectangular cross-section;

a pair of fence rails each having a rectangular cross-section; and a fence brace comprising:

a pair of opposing left and right fence rail flanges, each of the fence rail flanges comprising a planar central wall and a pair of forward-protruding side walls extending along opposing horizontal longitudinally-extending edges of the central wall, the sidewalls of the left fence rail flange being horizontally-aligned with the sidewalls of the right fence rail flange to define a pair of aligned channels for receiving the fence rails therein, and a plurality of fastener holes disposed within the central wall and the side walls of each fence rail flange for receiving fasteners to secure the fence rails therewith;

a central portion of the fence brace disposed between and formed with the central walls of the left and right fence rail flanges, the central portion of the fence brace comprising a planar central wall adapted to span the fence post and a pair of rearward-protruding side walls extending along opposing vertical longitudinally-extending edges of the central wall of the central portion, each side wall of the central portion protruding from the central wall of the central portion at a right angle and being connected to the central wall of one of the fence rail flanges at a right angle, and a plurality of fastener holes disposed within the central wall and the side walls of the central portion for receiving fasteners to secure the fence post therewith; and a horizontal picket fastener slot longitudinally-extending through the central wall of the central portion of the fence brace for receiving a fastener therethrough to affix a picket to the fence post with the fence brace therebetween.

2. The fence assembly, of claim 1, further comprising at least one picket, fastened to one of the fence rails by passing a fastener through the picket and into the fence rail.

3. The fence assembly of claim 1, wherein the fence brace is made of a material selected from the group consisting of steel, stainless steel, galvanized steel, aluminum, plastic, graphite, composite material, and any composite materials.

4. The fence assembly of claim 1, further comprising at least one picket, fastened to the fence post by passing a fastener through the picket and through the horizontal picket fastener slot and into the fence post.

* * * * *